US008061451B2

(12) United States Patent
Salzer, III et al.

(10) Patent No.: US 8,061,451 B2
(45) Date of Patent: Nov. 22, 2011

(54) VERTICAL DRILLING SYSTEM FOR CONTROLLING DEVIATION

(75) Inventors: John A. Salzer, III, Spring, TX (US); David Lane Evans, Conroe, TX (US); Glenn Patrick Coty, Spring, TX (US); Ronald Thorsten Eckmann, College Station, TX (US)

(73) Assignee: Strata Directional Technology, LLC, Houston, TX (US)

( * ) Notice: Subject to any disclaimer, the term of this patent is extended or adjusted under 35 U.S.C. 154(b) by 148 days.

(21) Appl. No.: 12/288,248

(22) Filed: Oct. 17, 2008

(65) Prior Publication Data

US 2010/0096189 A1 Apr. 22, 2010

(51) Int. Cl.
*E21B 17/10* (2006.01)

(52) U.S. Cl. ..... 175/325.3; 175/344; 166/241.6

(58) Field of Classification Search ..... 175/92, 175/348, 406, 344–346, 325.1, 325.3, 101, 175/107, 106; 166/241.6
See application file for complete search history.

(56) References Cited

U.S. PATENT DOCUMENTS 3,250,578 A * 5/1966 Lubbes ..... 175/325.2
3,259,193 A * 7/1966 Kellner ..... 166/237
4,217,966 A 8/1980 Garrett
4,765,417 A 8/1988 Perkin et al.
5,232,058 A * 8/1993 Morin et al. ..... 175/73
5,603,386 A * 2/1997 Webster ..... 175/76
7,321,293 B2 1/2008 Kennedy et al.
2008/0047754 A1 2/2008 Evans et al.

* cited by examiner

*Primary Examiner* — Daniel P Stephenson
*Assistant Examiner* — Yong-Suk Ro
(74) *Attorney, Agent, or Firm* — The Matthews Firm

(57) ABSTRACT

Systems for controlling deviations during drilling operations, including a transmission housing and a bearing assembly secured between a stator housing and a drill bit. Two stabilizers are secured to the transmission housing, and one stabilizer is secured to the bearing assembly to provide enhanced stability to the lower portion of the drill string. The stabilizers can have a triangular shaped body for increasing flow area, reducing annular velocity, and increasing stiffness of the system. The stabilizers can be rotationally offset from one another to facilitate maintaining the gauge of the borehole. The transmission housing can be a one-piece construction to minimize connections within the system and improve reliability. The stabilizers can include laser clad metal surfaces and diamond dome inserts to prevent wear and erosion. A triangular reamer can be included beneath the stabilizers to further prevent wear to the stabilizers and to add stability to the drill bit.

33 Claims, 8 Drawing Sheets

VERTICAL DRILLING SYSTEM FOR CONTROLLING DEVIATION

FIELD

The embodiments of the invention relate generally to systems for drilling operations and directional control of a drill string, that provides improved deviation control, improved flow area, and reduced annular velocity.

BACKGROUND

During drilling operations, especially vertical drilling operations, it is desirable to minimize and control deviations in drilling direction to maintain straight penetration. Conventional bottom hole assemblies for vertical drilling operations utilize concentric stabilizers attached to the exterior of the assembly, and coupled with a bearing assembly, to maintain drilling in a substantially vertical direction. These bottom hole assemblies typically include a single concentric stabilizer secured to the bearing housing of a downhole mud motor, and possibly one or more other stabilizers secured to the drill string above the mud motor. Normally, most bottom hole assemblies utilize one to two stabilizers, having a generally round cross-section, with each stabilizer aligned with one another in a generally parallel configuration.

Despite use of stabilizers and standard mud motors, conventional bottom hole assemblies remain subject to directional deviations, especially when penetrating through medium to hard formations, due to insufficient stability and stiffness in the lower portion of the drill string and assembly.

Further, the shape and arrangement of the stabilizers in typical assemblies has failed to maximize the lifespan of assembly components while maintaining bore size and integrity. Use of conventional stabilizers has achieved a less-than-optimal flow area around the stabilizers, resulting in a greater-than-optimal annular velocity. The increased annular velocity can wash out the wellbore, resulting in a reduction in the effectiveness of the assembly when drilling a vertical hole.

Additionally, conventional downhole mud motors experience a large degree of undesirable flexibility and wear, due to multiple internal connections within the motor, which can contribute to deviations in drilling operations while reducing the life expectancy of the motor and other assembly components.

A need exists for a vertical drilling system that uses stabilizers having a triangular cross section, that are rotationally offset from adjacent stabilizers to provide an improved measure of stiffness, an improved flow area, and a reduced annular velocity.

A further need exists for a vertical drilling system that provides improved resistance to bending and improved directional control to a drill string through use of at least three stabilizers secured between a mud motor stator housing and the drill bit, which provides the dual benefit of an increased penetration rate due to an increased amount of weight placed on the drill bit.

A need also exists for a vertical drilling system having a one-piece motor transmission housing and internal drive shaft that utilizes only two connections to communicate with the drill bit, providing improved reliability while enabling the system to undertake high torque operations.

The present embodiments meet these needs.

SUMMARY

Embodiments of the present vertical drilling system can include a motor in communication with a drill bit, the motor having a stator housing, and a transmission housing disposed between the stator housing and the drill bit. The motor can be a fluid-driven motor, such as a mud lubricated motor, and through the rotation of the motor, a rotational force can be imparted to the drill bit.

The transmission housing can be a one-piece construction, thereby minimizing connections within the system. Further, the transmission housing can utilize only a single connection at each end to communicate with the motor and the drill bit. Use of a one-piece transmission housing provides improved reliability to the present system, and the minimization of internal connections to secure the transmission within the system enables the transmission to withstand higher torque operations.

A bearing assembly, in communication with the motor and the drill bit, having a tubular housing, can be secured between the transmission housing and the drill bit. The bearing assembly communicates the rotational force from the motor to the drill bit while maintaining the tubular housing in a stationary orientation.

The present vertical drilling system further includes at least three stabilizers secured below the stator housing of the motor. At least two of the stabilizers can be secured to the transmission housing, and at least one of the stabilizers can be secured to the tubular housing of the bearing assembly.

Use of three or more stabilizers along the lower portion of the assembly, beneath the motor stator housing, provides improved stiffness and stability to the drill string, thereby minimizing directional deviations or unwanted movement of the drill string. Vertical drilling can therefore be maintained within one degree. The present configuration of stabilizers also maximizes the weight applied on the drill bit, improving the vertical penetration rate of the present system from 33% to 80%, when compared to conventional vertical drilling systems.

In an embodiment, one or more of the stabilizers can have three blades equidistantly disposed about its circumference, and a stabilizer body having a triangular shape. Further, each stabilizer can be rotationally offset from each adjacent stabilizer, such as by an angle ranging from 40 degrees to 90 degrees.

Use of triangular-shaped stabilizers, especially triangular stabilizers rotationally offset from one another, improves the quality of a borehole and subsequent logging and cementing operations. Stabilizers having a triangular shape also provide an improved flow area, and a reduced annular velocity. Compared to conventional vertical drilling systems, an embodiment of the present system can provide a 36% greater moment of inertia, a 34% greater polar moment of inertia, a 14% greater section modulus, a 15% increased flow area, and a 13% lower annular velocity.

One or more of the stabilizers can utilize a laser clad metallic surface having a plurality of diamond enhanced dome inserts disposed thereon. Use of this surface coupled with diamond enhanced materials prevents erosion of the stabilizers, thereby more effectively maintaining the gauge of the well bore and increasing the life expectancy of the stabilizers.

In an embodiment, the present system can include a reamer in communication with the motor and the drill bit, disposed between the bearing assembly and the drill bit. The rotational force from the motor can be imparted to the reamer to enable the reamer to maintain the integrity of the borehole. The reamer can have three groups of rollers equally spaced about its circumference, providing a triangular shape to the reamer. Use of the reamer can increase the lifespan of the stabilizers by preventing wear, while decreasing torque on the present system, improving the flow area of the present system, and reducing annular velocity. Additionally, the reamer can provide the dual benefit of additional stability to the lower portion of the present system, functioning similar to a near-bit stabilizer.

BRIEF DESCRIPTION OF THE DRAWINGS

In the detailed description of the embodiments presented below, reference is made to the accompanying drawings, in which.

The present embodiments are detailed below with reference to the listed Figures.

DETAILED DESCRIPTION OF THE EMBODIMENTS

Before explaining the present embodiments in detail, it is to be understood that the embodiments are not limited to the particular descriptions and that the embodiments can be practiced or carried out in various ways.

Figure 1:
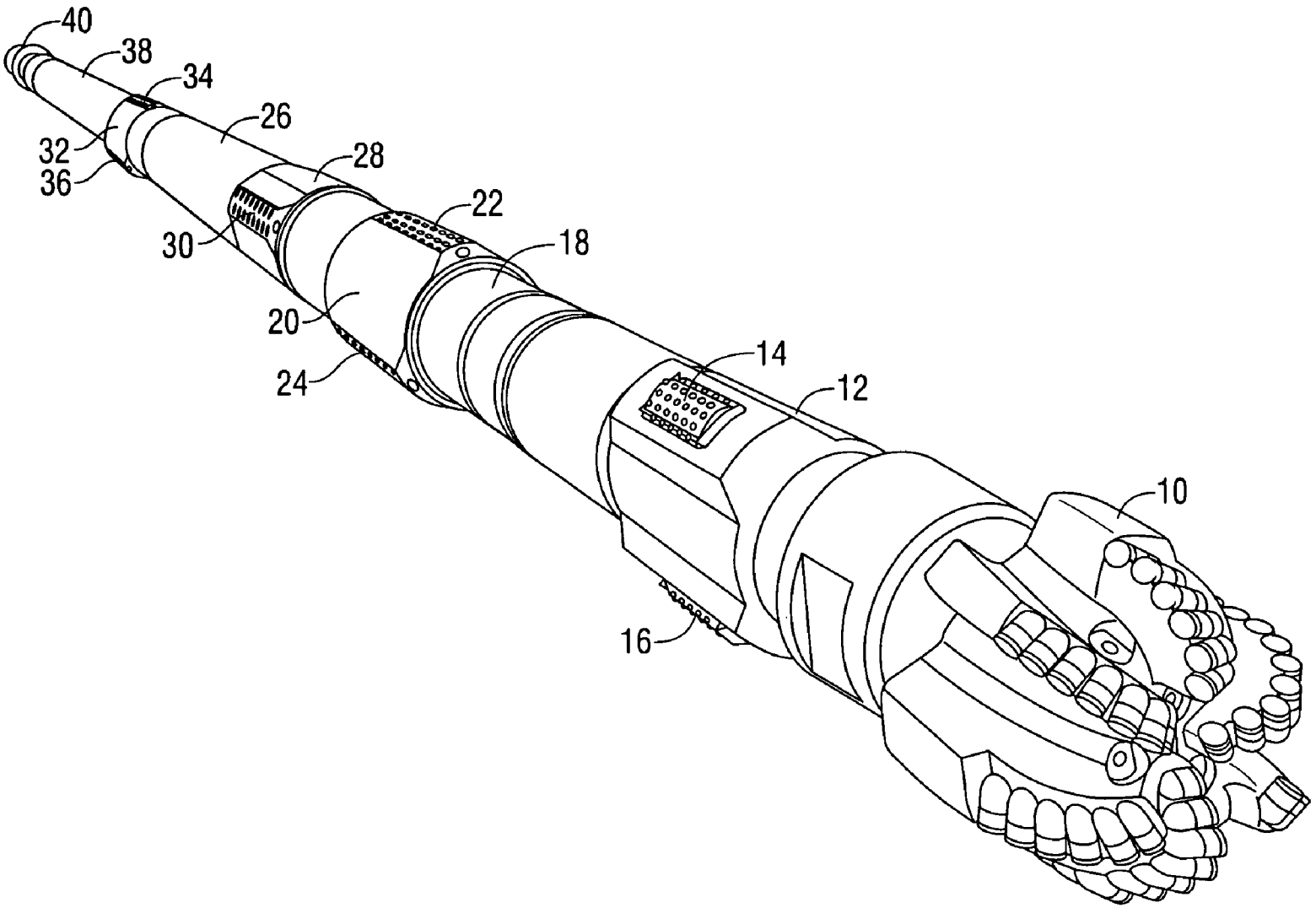
FIG. 1 depicts an embodiment of the present system.

Referring now to FIG. 1, a perspective view of an embodiment of the present system is depicted, engaged with a drill string (40). In the present system, a drill bit (10) is shown engaged with a reamer (12). The dimensions of the drill bit (10) and attached components can be varied depending on the diameter, depth, and rate of penetration necessary for a borehole.

The reamer is depicted having three sets of rollers, of which a first set of rollers (14) and a second set of rollers (16) are visible, providing the reamer (12) with a generally triangular shape. The triangular shape of the reamer (12) facilitates maintaining the gauge of the borehole while preventing wear on system components, such as stabilizers, disposed above the reamer (12). Additionally, the proximity of the reamer (12) to the drill bit (10) enables the reamer (12) to provide stability and weight to the drill bit (10), increasing the rate of penetration while minimizing deviation.

Figure 2:
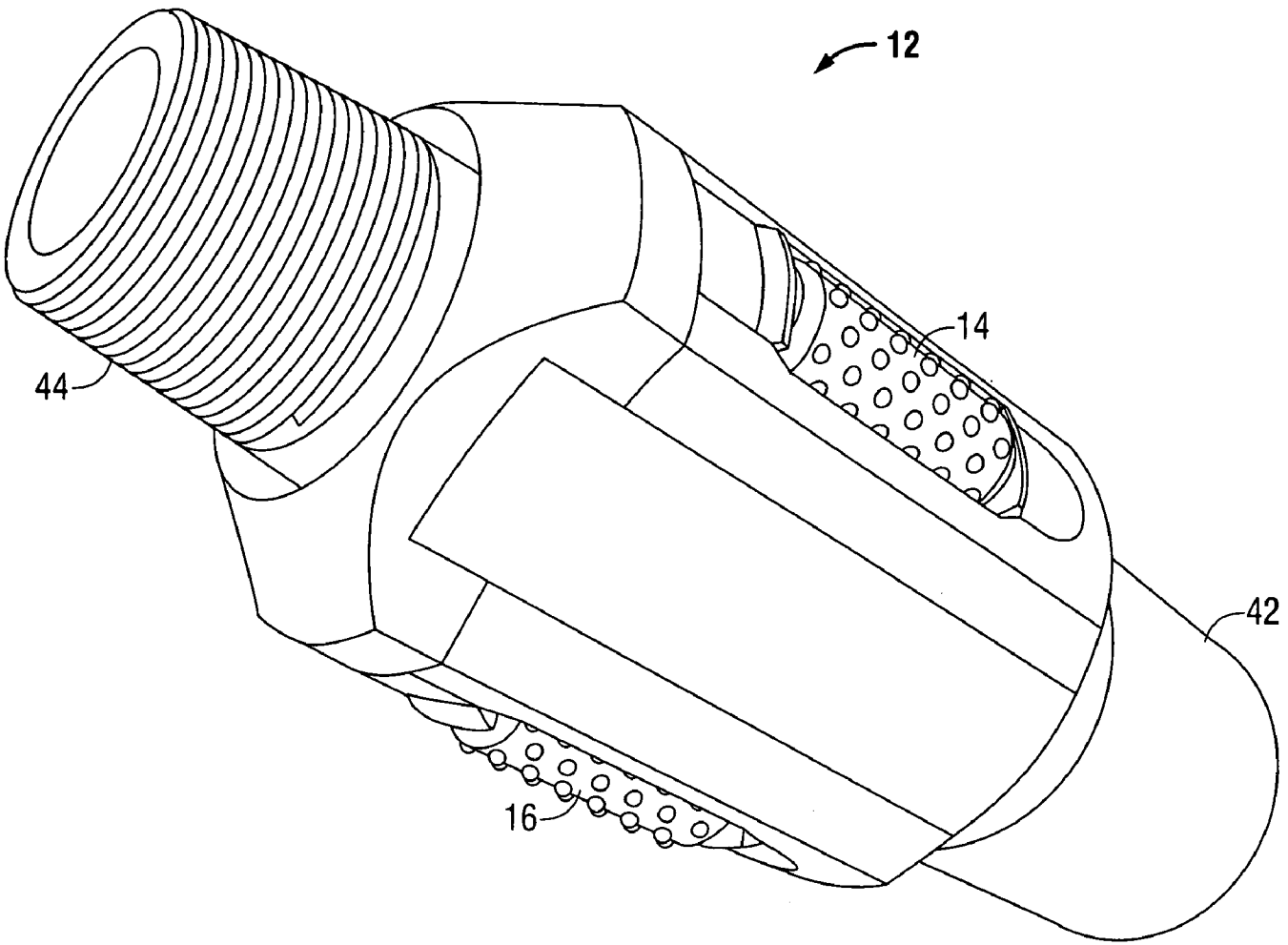
FIG. 2 depicts an embodiment of a reamer usable with the present system.

FIG. 2 depicts an isometric view of an embodiment of the reamer (12), on which the first set of rollers (14) and second set of rollers (16) are visible. The reamer (12) is also shown having a first end (42), which can have interior threads for engaging the drill bit, and a second end (44), which is depicted having exterior threads for engaging adjacent components of the system. In an embodiment, the rollers (14, 16) can include a laser clad metallic surface, one or more diamond dome inserts, or combinations thereof, for maximizing the useful life of the reamer (12) and preventing erosion of the reamer (12) and any stabilizers or other components disposed above the reamer (12).

A usable reamer is described in U.S. Pat. No. 7,308,956, the entirety of which is incorporated herein by reference.

FIG. 1 depicts a bearing assembly (18) engaged with and disposed above the reamer (12). The bearing assembly (18) is shown as a generally tubular housing having a stabilizer (20) disposed thereon. The stabilizer (20) is depicted having three blades equidistantly disposed about its circumference, of which a first blade (22) and a second blade (24) are visible. The stabilizer (20) is also depicted having a generally triangular-shaped body.

The triangular shape of the stabilizer (20) provides a superior moment of inertia and section modulus, an increased flow area, and a reduced annular velocity to the present system, compared to use of a conventional stabilizer having a round or square cross-section.

Figure 3:
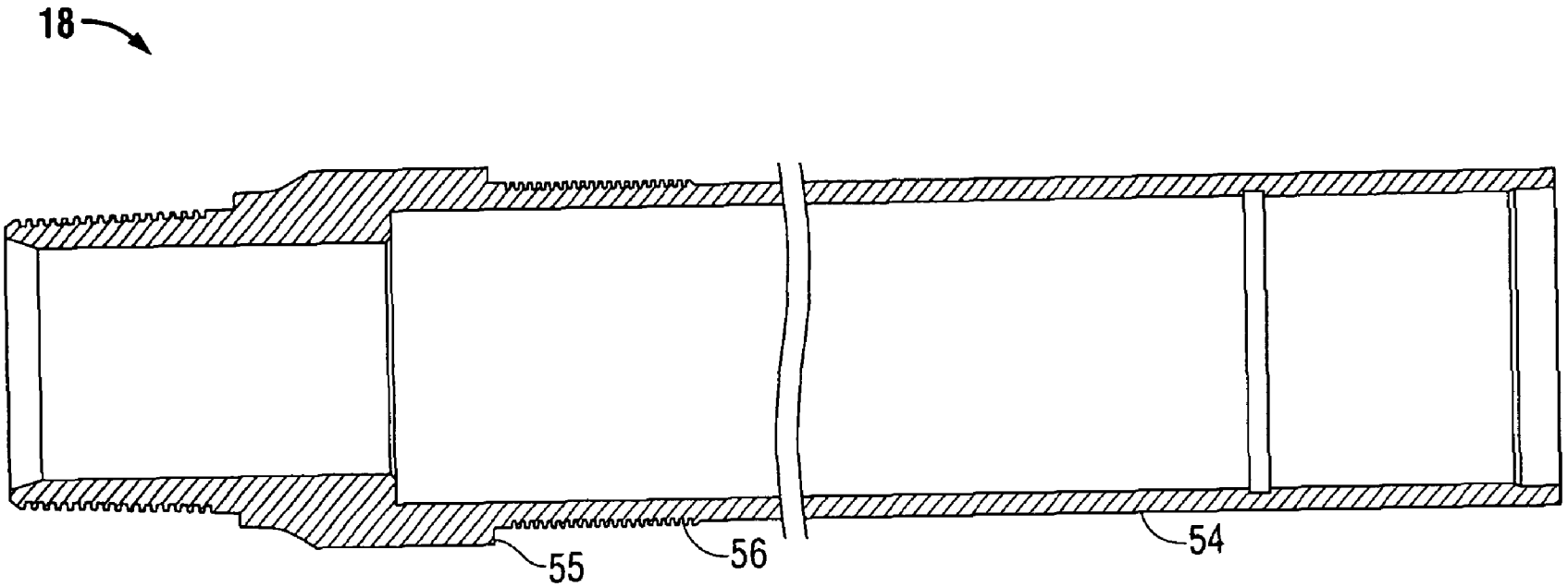
FIG. 3 depicts an embodiment of a tubular housing of a bearing assembly usable with the present system.

FIG. 3 depicts a cross-sectional view of the tubular housing (54) of the bearing assembly (18). The tubular housing (54) is shown having a threaded portion (56) for engaging the stabilizer (depicted in FIG. 1), adjacent a shoulder (55) against which the stabilizer can abut once secured. The shoulder (55) can include an adjacent relief groove or similar depression between the shoulder (55) and the threaded portion (56).

Figure 4:
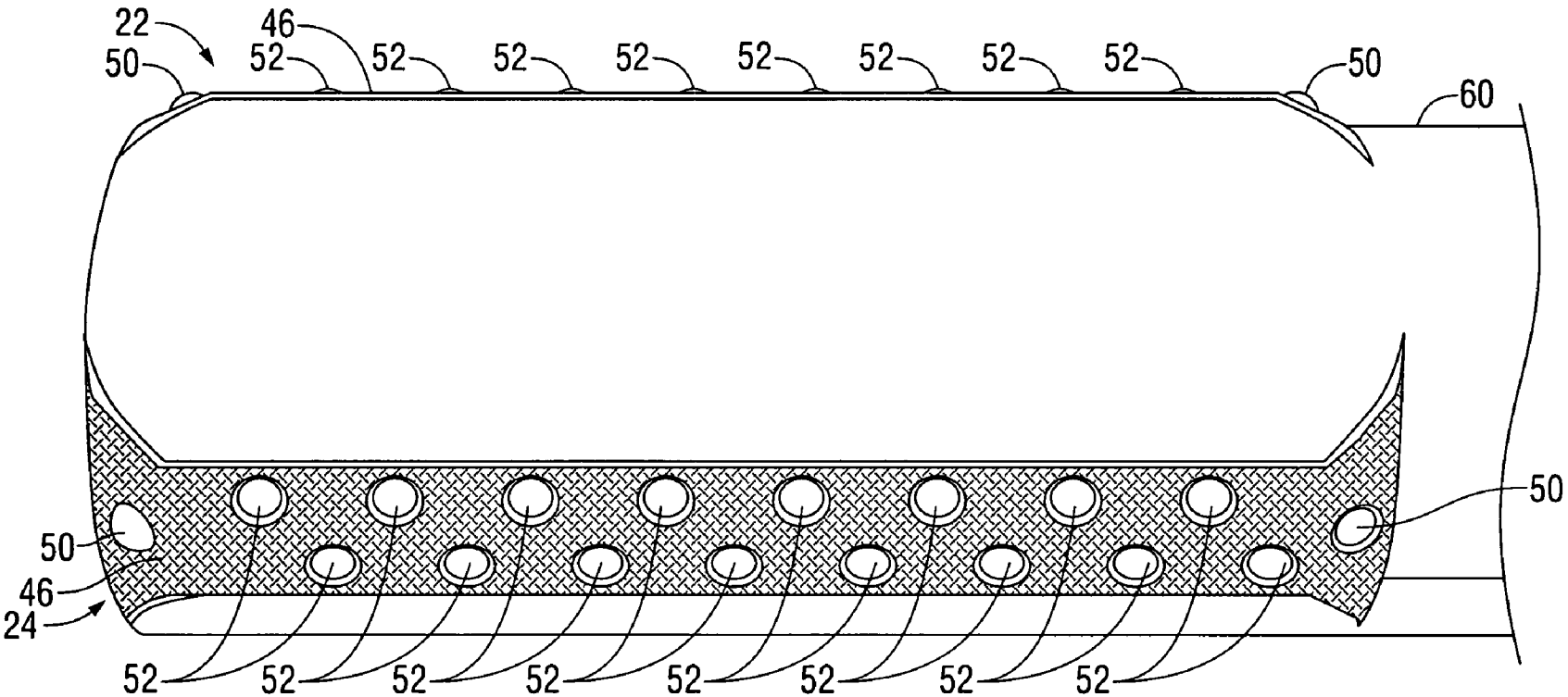
FIG. 4 depicts an embodiment of a stabilizer usable with the present system.

FIG. 4 depicts a side view of the stabilizer (20), which is shown having the first blade (22) and the second blade (24) disposed thereon. A third blade (not visible in FIG. 4) is equidistantly disposed on the opposite side of the stabilizer (20), such that each blade is disposed approximately 120 degrees from each adjacent blade about the circumference of the stabilizer (20).

Each of the blades (22, 24) is shown having a laser clad metal surface (46) with a plurality of holes disposed therethrough. The holes are each shown accommodating a diamond dome insert (50, 52). A single diamond dome insert (50) is shown at the end of each blade (22, 24), along an angled portion of the blade (22, 24), which facilitates expanding and maintaining the borehole. The diamond dome inserts (50) are disposed at both ends of the blades (22, 24) to protect the stabilizer (20) and facilitate drilling both in a forward direction, and in a reverse direction, such as when back-reaming a borehole.

Additional diamond dome inserts (52) are depicted disposed on the blades (22, 24) in two staggered rows along the length of the blades (22, 24) for protecting the stabilizer (20) from wear and erosion.

The stabilizer (20) is also shown having a threaded portion (60), with interior threads for engaging a complementary threaded portion of a component of the present system.

Figure 5:
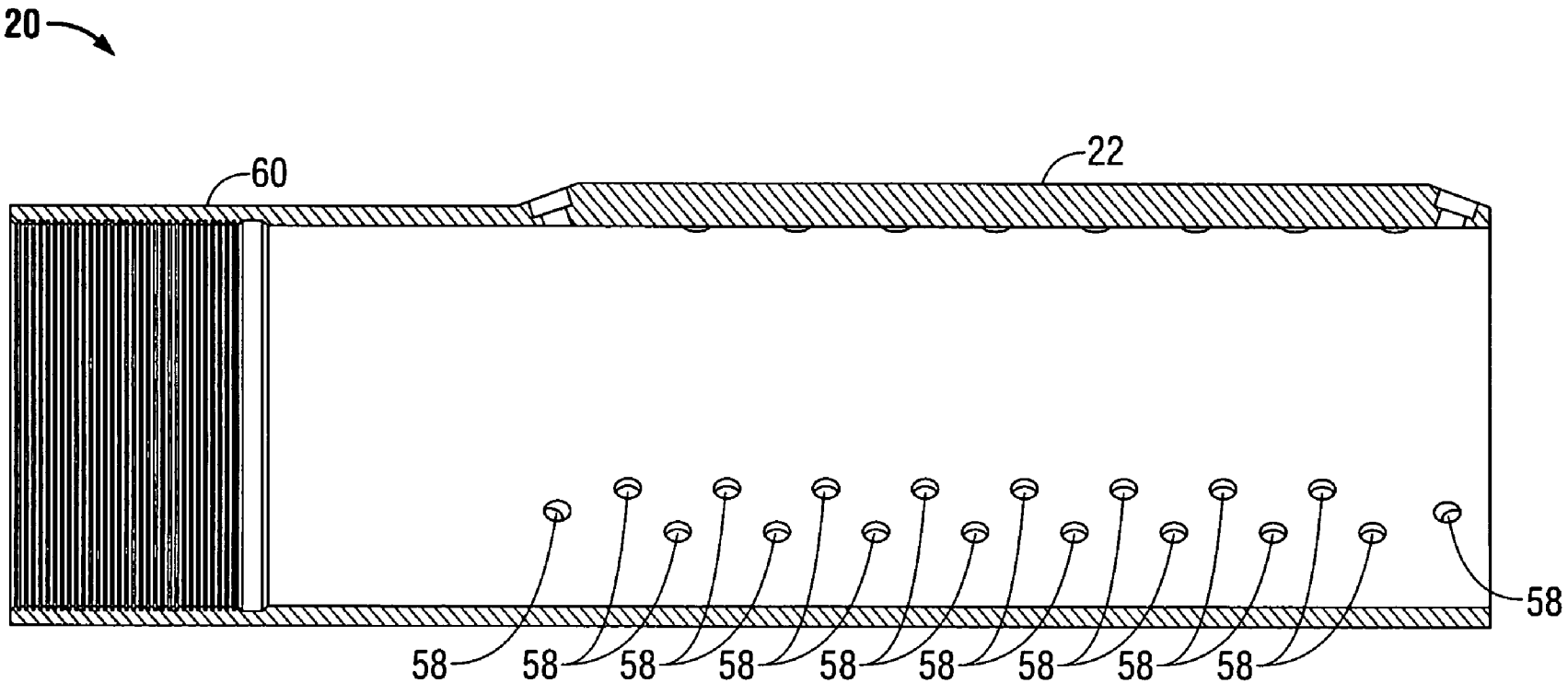
FIG. 5 depicts a perspective cross-sectional view of the stabilizer of FIG. 4.

FIG. 5 depicts a perspective cross-sectional view of the stabilizer of FIG. 4. The stabilizer (20) is shown having a threaded portion (60) at one end, opposite the stabilizer body. The first blade (22) is shown disposed on the stabilizer body.

A plurality of holes (58) are shown disposed through the stabilizer (20) at the location of the second blade (not visible in FIG. 5), for accommodating diamond dome inserts (depicted in FIG. 4).

In an embodiment, the stabilizer (20) can have an overall length of about 27.00 inches, with the threaded portion (60) having a length of about 4.200 inches, and the remainder of the stabilizer body having a length of about 22.800 inches. The outer diameter of the stabilizer body can be about 7.500 inches, and the inner diameter can be about 6.854 inches at the threaded portion (60) and about 6.805 inches at the opposite end. However, other lengths and diameters of a stabilizer are also usable.

In an embodiment, each blade can have a length of about 15.50 inches, with tapering edges that taper toward the stabilizer body at an angle of approximately 30 degrees, and a width of about 2.203 inches. Each hole disposed through the stabilizer body and blade can have a diameter of about 0.438 inches. The blades can each have 15 holes for accommodating diamond dome inserts, disposed in staggered horizontal rows spaced approximately 1.818 inches from each adjacent hole, however other numbers and arrangements of holes and diamond dome inserts are also usable.

Each of the three blades disposed on a stabilizer can have holes and diamond dome inserts offset from each other blade of the stabilizer. For example, the first hole on the first blade can be spaced approximately 0.630 inches from the front edge of the blade, while the first hole on the second blade is spaced about 0.933 inches from the front edge, and the first hole on the third blade is spaced about 1.236 inches from the front edge.

FIG. 1 further depicts a transmission housing (26) connected to and disposed above the bearing assembly (18). A stator housing (38) is shown connected to and disposed above the transmission housing (26).

A second stabilizer (28) and a third stabilizer (32) are depicted disposed on the transmission housing (26). The second and third stabilizers (28, 32) are shown having three blades disposed thereon, of which blade (30) is visible on the second stabilizer (28), and blade (34) and blade (36) are visible on the third stabilizer (32). Both the second and third stabilizers (28, 32) are shown having a generally triangular-shaped body.

The second and third stabilizers (28, 32) can be similar in construction to the first stabilizer (20) secured to the bearing assembly (18), depicted in FIGS. 4 and 5.

FIG. 1 depicts each of the stabilizers (20, 28, 32) rotationally offset from each adjacent stabilizer. The second stabilizer (28) is depicted rotated approximately 60 degrees in relation to the first stabilizer (20) and the third stabilizer (32) for maintaining the gauge of the borehole, increasing flow area, and reducing annular velocity. Other rotational offsets are also contemplated. For example, each stabilizer could be offset 40 degrees from each adjacent stabilizer, 90 degrees from each adjacent stabilizer, or any angle therebetween.

Figure 6:
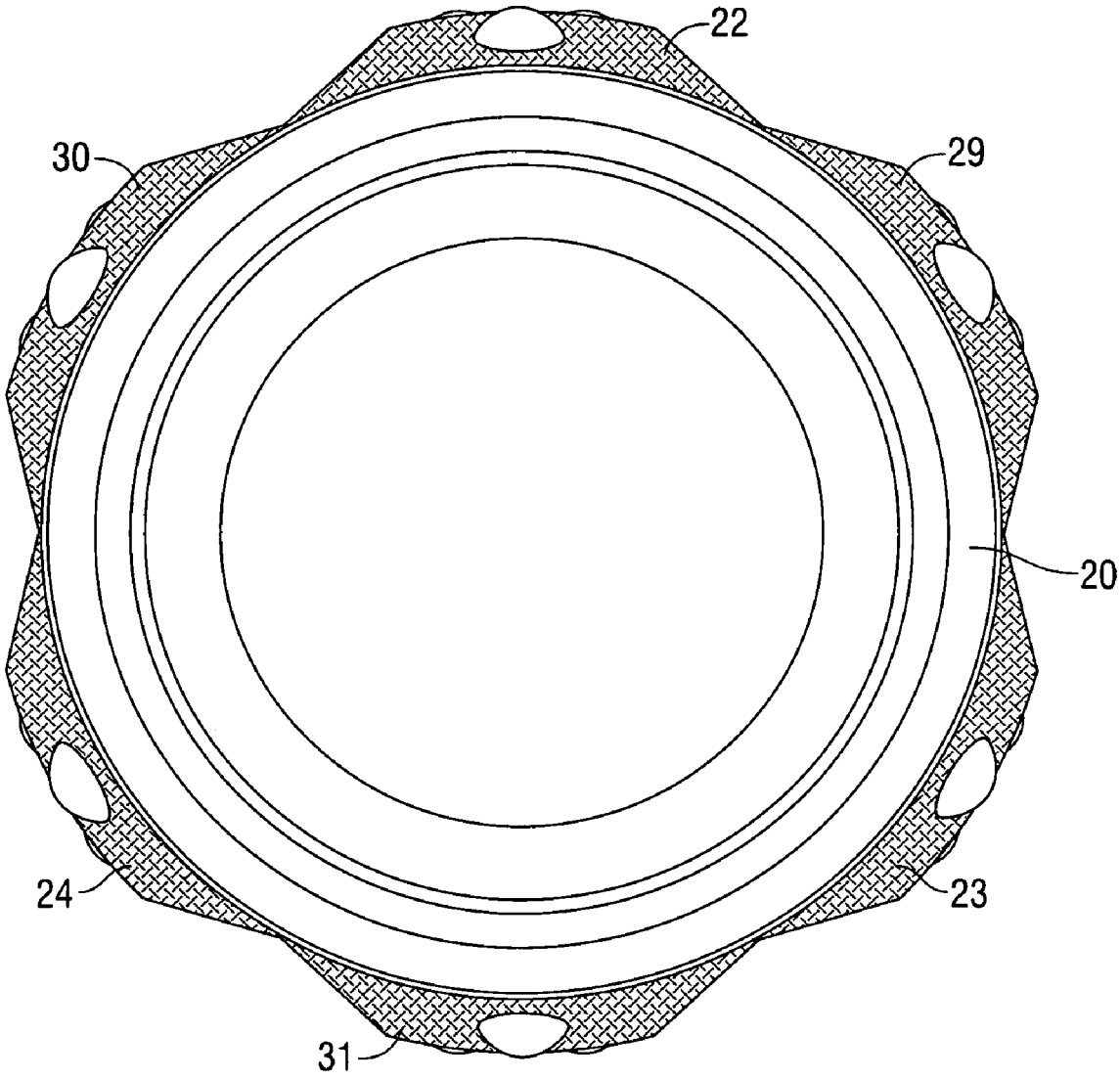
FIG. 6 depicts an end view showing the relative orientation of two stabilizers.

FIG. 6 depicts an end view of the stabilizers, of which the first stabilizer (20) is visible, having a triangular-shaped body with a first blade (22), a second blade (23), and a third blade (24) disposed thereon. Each of the blades (22, 23, 24) on the first stabilizer (20) are disposed approximately 120 degrees from one another.

A fourth blade (29), fifth blade (30), and sixth blade (31), attached to the second stabilizer (not visible in FIG. 6) disposed above the first stabilizer (20) are also depicted. The second stabilizer is rotationally offset approximately 60 degrees in relation to the first stabilizer (20), such that the fourth blade (29) is disposed at the midpoint between the first blade (22) and the second blade (23), the fifth blade (30) is disposed at the midpoint between the first blade (22) and the third blade (24), and the sixth blade (31) is disposed at the midpoint between the third blade (24) and the second blade (23). The rotational offset of the second stabilizer thereby provides improved capability to the present system for maintaining the gauge of the borehole.

Figure 7:
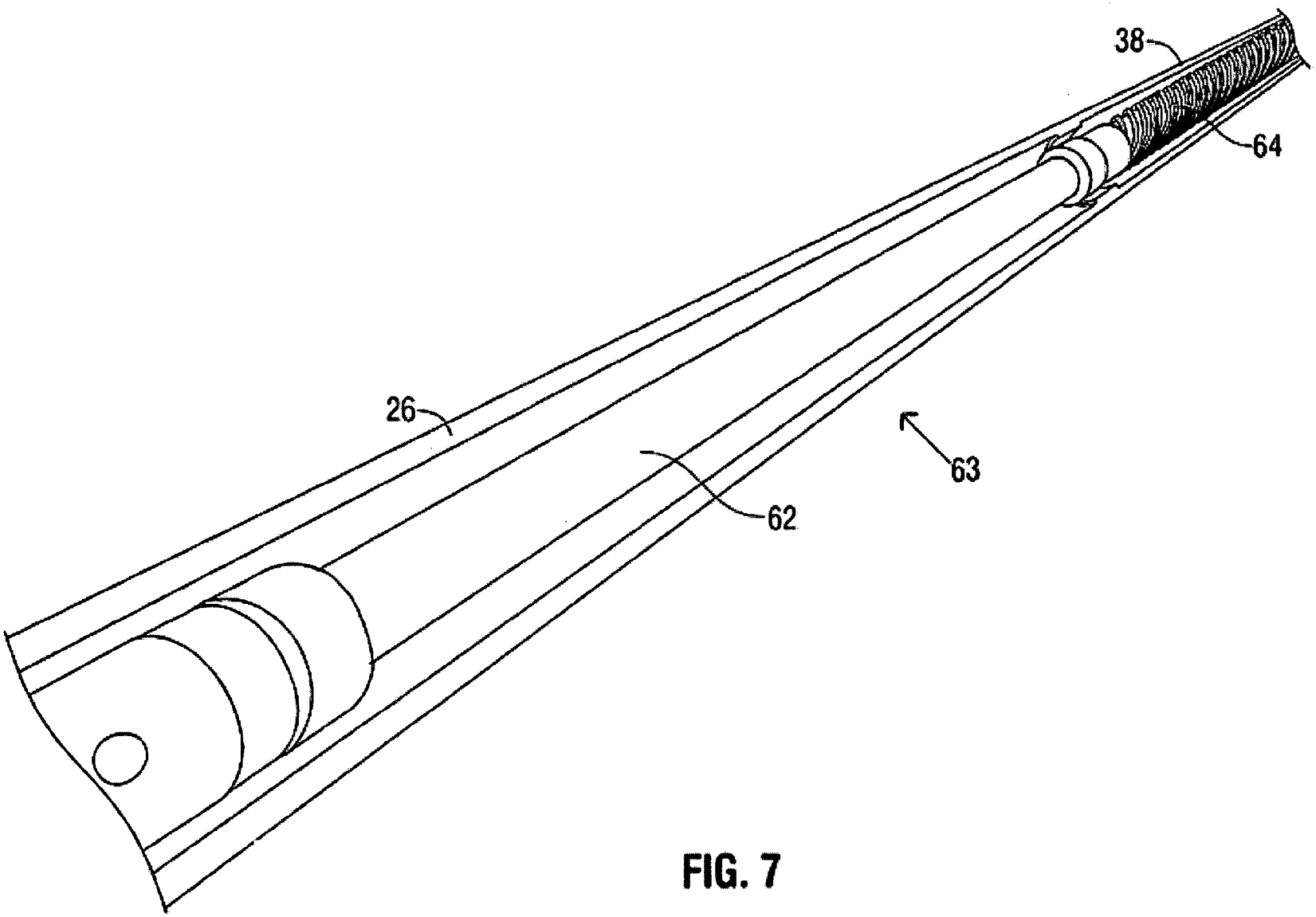
FIG. 7 depicts a cut-away view of a motor, having a transmission housing and shaft usable with the present system.

FIG. 7 depicts a cut away view of an embodiment of a motor (63), usable with the present system. The motor (63) is shown having a transmission housing (26). The transmission housing (26) is shown as a one-piece construction, which minimizes connections in the present system. Use of a one-piece transmission housing (26) provides improved durability and reliability to the present system, compared to conventional multi-part housings.

A transmission shaft (62) is shown contained within the transmission housing (26). The transmission shaft (62) is also shown as a one-piece construction, having connections only to engage adjacent components, resulting in improved durability, reliability, and the capability for a higher torque transmission.

The stator housing (38) is shown adjacent to the transmission housing (26). The transmission shaft (62) is shown engaged with a rotor (64) contained within the stator housing (38).

Figure 8:
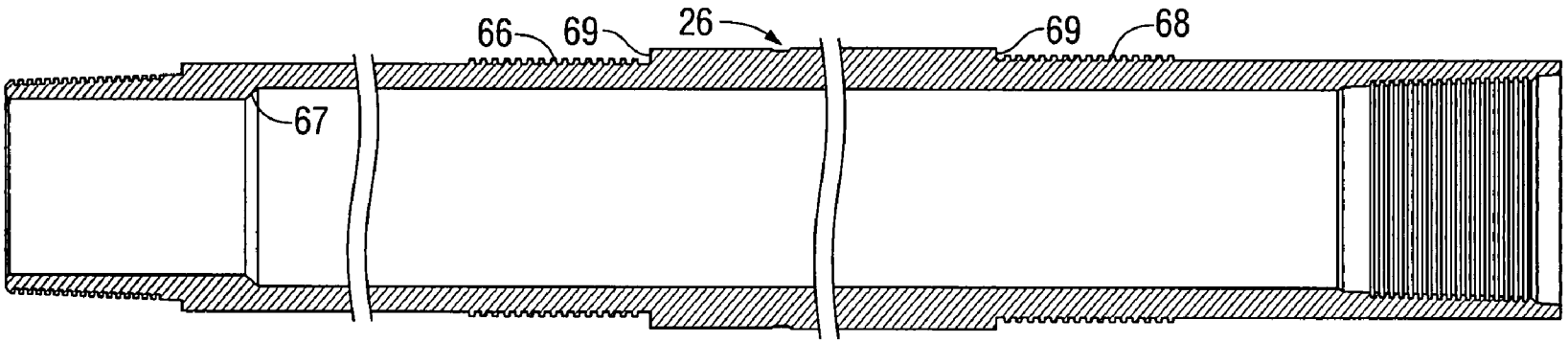
FIG. 8 depicts a cross-sectional view of the transmission housing of FIG. 7.

FIG. 8 depicts a cross-sectional view of an embodiment of the transmission housing (26). The transmission housing is shown having an upper threaded portion (66) and a lower threaded portion (68), for engagement with the third stabilizer (depicted in FIG. 1) and second stabilizer (depicted in FIG. 1), respectively.

In an embodiment, the threaded portions (66, 68) can be oriented such that the rotational motion of the transmission housing (26) and the attached stabilizers within the borehole during drilling operations causes the attached stabilizers to be tightened to the threaded portions (66, 68), rather than loosened. For example, the second stabilizer can have right-handed threads for engagement with the lower threaded portion (68), while the third stabilizer has left-handed threads for engagement with the upper threaded portion (66).

In an embodiment, the transmission housing (26) can have a length of approximately 107.830 inches, with an outer diameter of about 7.500 inches and an inner diameter of about 4.88 inches at its upper end and 5.3 inches beneath an interior shoulder (67). The transmission housing (26) is also shown having exterior shoulders (69), each having a height of about 0.365 inches, against which the stabilizers can abut when secured to the transmission housing (26).

Figure 9:
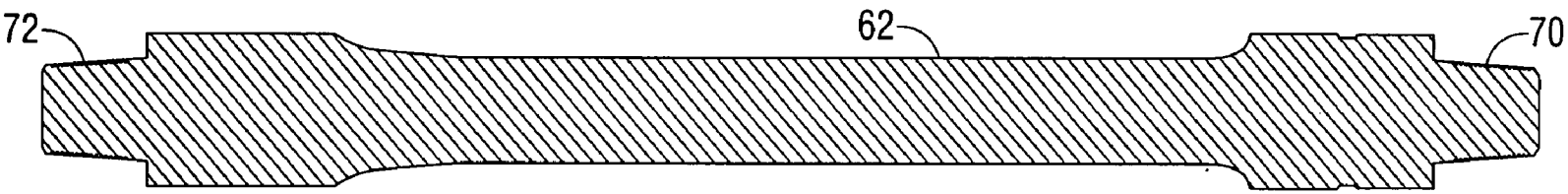
FIG. 9 depicts a side cross-sectional view of the transmission shaft of FIG. 7.

FIG. 9 depicts a side cross-sectional view of an embodiment of the transmission shaft (62). The transmission shaft (62) is shown as a one-piece construction having an overall length of about 94.75 inches. A lower engagement end (70) of the transmission shaft (62) is usable to engage the bearing assembly (depicted in FIG. 1), while an upper engagement end (72) of the transmission shaft is usable to engage the rotor (depicted in FIG. 7). The diameter of the transmission shaft (62) can be varied depending on the dimensions of the transmission housing, though in an embodiment, the diameter of the transmission shaft (62) can range from 2.814 inches at its midpoint, to 4.000 inches to 4.188 inches proximate to the engagement ends (70, 72).

The arrangement and configuration of the three stabilizers (20, 28, 32) depicted in FIG. 1, including each stabilizer being rotationally offset from each adjacent stabilizer by an angle ranging from forty degrees to ninety degrees or more, provides improved stability to the lower portion of the drill string (40) by minimizing unwanted movement of the drill string, provides additional weight to the drill bit (10) for increasing the rate of penetration, and ensures maintenance of the gauge of the borehole. Further, the present system provides a greater moment of inertia, a greater polar moment of inertia, a greater section modulus, an increased flow area, and a reduced annular velocity compared to conventional vertical drilling assemblies.

While these embodiments have been described with emphasis on the embodiments, it should be understood that within the scope of the appended claims, the embodiments might be practiced other than as specifically described herein.

What is claimed is:

1. A system for vertical drilling operations and minimizing deviations of a drill string from a vertical direction, the system comprising:

a motor mounted in the drill string, wherein the motor is in communication with a drill bit, wherein the motor comprises a stator housing and a transmission housing, wherein the transmission housing is disposed between the stator housing and the drill bit, wherein the motor is driven by fluid in the drill string, and wherein the motor thereby imparts a rotational force to the drill bit;

a bearing assembly in communication with the motor and the drill bit, wherein the bearing assembly comprises a tubular housing disposed between the transmission housing and the drill bit, and wherein the rotational force of the motor translates through the bearing assembly to the drill bit while the tubular housing is maintained in a stationary orientation with respect to the drill bit as the drill bit rotates; and a plurality of stabilizer bodies each comprising a plurality of blades fixedly formed therewith, wherein at least two of the stabilizer bodies are secured to the transmission housing below the stator housing and at least one of the stabilizer bodies is secured to the tubular housing below the stator housing for providing improved stability to a lower portion of the drill string and minimizing directional deviations of the drill string during vertical drilling operations, wherein at least one of the plurality of stabilizer bodies comprises a substantially triangular cross-sectional area oriented perpendicular to a longitudinal axis of the drill string, and wherein the plurality of stabilizer bodies are disposed on the drill string in a rotationally offset manner so that the plurality of blades of an associated stabilizer body are rotationally offset from the plurality of blades of each adjacent stabilizer body.

2. The system of claim 1, wherein each of the plurality of stabilizer bodies comprises a substantially triangular cross-sectional area perpendicular to a longitudinal axis of the drill string.

3. The system of claim 2, wherein the plurality of blades of each stabilizer body are rotationally offset from the plurality of blades of each adjacent stabilizer body by an angle ranging from forty degrees to ninety degrees.

4. The system of claim 2, wherein each of the plurality of stabilizer blades of the corresponding stabilizer body are formed integrally therewith.

5. The system of claim 2, wherein the drillstring is maintained within one degree of a centerline during drilling operations.

6. The system of claim 1, wherein at least one of the stabilizer bodies comprises a laser clad metallic surface with a plurality of diamond enhanced dome inserts disposed thereon for preventing erosion of the stabilizer bodies and maintaining the gauge of a well bore.

7. The system of claim 1, wherein the transmission housing comprises a one-piece construction for minimizing connections within the system and improving system reliability and durability.

8. The system of claim 1, wherein the transmission housing utilizes only two connections to communicate with the motor and the drill bit for improving system reliability and enabling the transmission housing to withstand high torque drilling operations.

9. The system of claim 1, further comprising a reamer in communication with the motor and the drill bit, wherein the reamer is disposed between the bearing assembly and the drill bit, and wherein the motor imparts a rotational force to the reamer for maintaining borehole integrity.

10. The system of claim 9, wherein the reamer comprises three groups of rollers providing a triangular shape to the reamer for increasing the lifespan of the stabilizer bodies, decreasing torque on the system, improving flow area of the system, and reducing annular velocity of the system.

11. A system for maintaining vertical orientation of a drill string in communication with a drill bit during vertical drilling operations, the system comprising:

at least three stabilizers secured to a lower portion of the drill string, each of the at least three stabilizers further comprising a stabilizer body configured with a triangular shaped cross-sectional area oriented perpendicular to a longitudinal axis of the drill string, and a plurality of blades fixedly secured to each stabilizer body at points associated with corners of the stabilizer bodies, wherein each of the stabilizer bodies are disposed on the drill string so the respective plurality of blades are rotationally offset from the plurality of blades of each adjacent stabilizer in order to provide improved stability to the lower portion of the drill string, minimize directional deviations of the drill string during vertical drilling operations, improve flow area, reduce annular velocity, and maintain borehole integrity.

12. The system of claim 11, wherein the cross-sectional area of one of the at least three stabilizer bodies is equilateral.

13. The system of claim 11, wherein at least one of the stabilizers comprises a laser clad metallic surface with a plurality of diamond enhanced dome inserts disposed thereon for preventing erosion of the stabilizer and maintaining the gauge of a well bore.

14. The system of claim 11, wherein the rotational offset of each adjacent stabilizer is in a range of about forty degrees to ninety degrees.

15. The system of claim 11, further comprising a motor mounted in the drill string, wherein the motor is in communication with the drill bit, wherein the motor comprises a stator housing and a transmission housing, wherein the transmission housing is disposed between the stator housing and the drill bit, wherein the motor is driven by fluid in the drill string, wherein the motor thereby imparts a rotational force to the drill bit, and wherein at least two stabilizers of the at least three stabilizers are secured to the transmission housing.

16. The system of claim 15, wherein the transmission housing comprises a one-piece construction for minimizing connections within the system and improving system reliability and durability.

17. The system of claim 15, wherein the transmission housing utilizes only two connections to communicate with the drill string for improving system reliability and enabling the transmission housing to withstand high torque drilling operations.

18. The system of claim 15, further comprising a bearing assembly in communication with the motor and the drill bit, wherein the bearing assembly comprises a tubular housing disposed between the transmission housing and the drill bit, wherein the rotational force of the motor translates through the bearing assembly to the drill bit while maintaining the tubular housing in a stationary orientation, and wherein at least one stabilizer of the at least three stabilizers is secured to the tubular housing for providing improved stability to the lower portion of the drill string.

19. The system of claim 15, further comprising a reamer in communication with the drill string, wherein the reamer is disposed between the at least three stabilizers and the drill bit, and wherein the motor imparts a rotational force to the reamer for maintaining borehole integrity.

20. The system of claim 19, wherein the reamer comprises three groups of rollers providing a triangular shape for increasing the lifespan of the stabilizers, decreasing torque on the system, improving flow area of the system, and reducing annular velocity of the system.

21. The system of claim 11, wherein the drillstring is maintained within one degree of a centerline during drilling operations.

22. The system of claim 11, wherein each of the plurality of stabilizer blades of the corresponding stabilizer body are formed integrally therewith.

23. A system for vertical drilling operations and directional control of a drill string, the system comprising:

a motor in communication with a drill bit, wherein the motor comprises a stator housing and a transmission housing, wherein the transmission housing is disposed between the stator housing and the drill bit, wherein the motor is driven by fluid in the drill string, wherein the motor thereby imparts a rotational force to the drill bit, and wherein the transmission housing comprises a one-piece construction for minimizing connections within the system and improving system reliability and durability;

a plurality of stabilizers secured to a lower portion of the drill string below the stator housing, wherein at least two of the stabilizers are secured to the transmission housing below the stator housing for providing improved stability to the lower portion of the drill string and minimizing directional deviation during vertical drilling operations, and wherein each of the plurality of stabilizers comprises a stabilizer body configured with a substantially triangular cross-sectional area oriented perpendicular to a longitudinal axis of the drill string in order to improve the flow area around the stabilizer and reduce annular velocity of the system, and a plurality of blades fixedly secured to the stabilizer body at points associated with corners of the triangular cross-sectional area.

24. The system of claim 23, wherein the transmission housing utilizes only two connections to communicate with the drill string for improving system reliability and enabling the transmission housing to withstand high torque drilling operations.

25. The system of claim 23, further comprising a bearing assembly in communication with the motor and the drill bit, wherein the bearing assembly comprises a tubular housing disposed between the transmission housing and the drill bit, and wherein the rotational force of the motor translates through the bearing assembly to the drill bit while the tubular housing is maintained in a stationary orientation as the drill bit rotates.

26. The system of claim 23, wherein each of the stabilizers is rotationally offset from each adjacent stabilizer of the plurality of stabilizers.

27. The system of claim 26, wherein each stabilizer is rotationally offset from each adjacent stabilizer by an angle ranging from forty degrees to ninety degrees.

28. The system of claim 23, wherein at least one of the stabilizers comprises a laser clad metallic surface with a plurality of diamond enhanced dome inserts disposed thereon for preventing erosion of the stabilizer and maintaining the gauge of a well bore.

29. The system of claim 23, further comprising a reamer in communication with the motor, wherein the reamer is disposed between the motor and the drill bit, and wherein the motor imparts a rotational force to the reamer for maintaining borehole integrity.

30. The system of claim 29, wherein the reamer comprises three groups of rollers providing a triangular shape for increasing the lifespan of the stabilizers, decreasing torque on the system, improving flow area of the system, and reducing annular velocity of the system.

31. The system of claim 23, wherein the at least one stabilizer comprises an equilateral cross-sectional area.

32. The system of claim 23, wherein a first blade comprises a first tapered edge and a second blade comprises a second tapered edge, and wherein the first tapered edge and the second tapered edge are connected to each other by a first substantially planar surface formed therebetween.

33. The system of claim 32, wherein the first blade comprises a second tapered edge and a third blade comprises a third tapered edge, and wherein the second tapered edge of the first blade and the third tapered edge are connected to each other by a second substantially planar surface formed therebetween.

* * * * *